United States Patent [19]

Castleberry

[11] 4,420,896

[45] Dec. 20, 1983

[54] METHOD FOR FABRICATION OF ELECTROSCOPIC DISPLAY DEVICES AND TRANSMISSIVE DISPLAY DEVICES FABRICATED THEREBY

[75] Inventor: Donald E. Castleberry, Schenectady, N.Y.

[73] Assignee: General Electric Company, Schenectady, N.Y.

[21] Appl. No.: 303,275

[22] Filed: Sep. 17, 1981

[51] Int. Cl.[3] ..... A47F 11/06; G09F 9/00

[52] U.S. Cl. ..... 40/427; 350/486; 340/763

[58] Field of Search ..... 40/427, 447, 448, 449, 40/450, 451, 452; 340/815.27, 764, 763, 783, 815.24, 815.06, 815.07; 350/486, 269

[56] References Cited

U.S. PATENT DOCUMENTS 4,178,077 12/1979 te Velde ..... 350/486

OTHER PUBLICATIONS

"A Family of Electroscopic Displays," T. S. te Velde Society for Information Display SID80 Digest, pp. 116 and 117.

*Primary Examiner*—Gene Mancene
*Assistant Examiner*—James Hakomaki
*Attorney, Agent, or Firm*—Geoffrey H. Krauss; James C. Davis, Jr.; Marvin Snyder

[57] ABSTRACT

An electroscopic display device includes a plurality of small, moveable plates which are each electrostatically deflectable from a resting position, at a rear surface of a display cell, to a display position adjacent to a viewable front surface of the cell. A portion of the electrode structure remains fixedly adjacent to the cell rear surface and a second electrode is positioned fixedly adjacent to the front surface. Light entering through the rear of the cell is internally reflected before exiting through the front surface, only if the moveable electrode portion has been electrostatically attracted to the fixed front electrode. The display device is fabricated by masking and subsequent etching of a plurality of layers formed upon the surface of a display substrate, to provide the moveable electrode, spring and fixed electrode as an integrated structure.

20 Claims, 8 Drawing Figures

METHOD FOR FABRICATION OF ELECTROSCOPIC DISPLAY DEVICES AND TRANSMISSIVE DISPLAY DEVICES FABRICATED THEREBY

BACKGROUND OF THE INVENTION

The present invention relates to display devices and, more particularly, to a novel method for fabricating electroscopic display devices and to transmissive electroscopic display devices fabricated thereby.

It is highly desirable to provide flat panel matrix displays. Such displays often employ a matrix array of light valve elements. Heretofore, various liquid crystal effects have been suggested and utilized for these light valves, albeit with certain tradeoffs having to be made, whereby high brightness, high contrast, fast response and matrix addressability are not often all achieved in a single display. Recently, a reflective electroscopic display has been described by T. S. te Velde at the 1980 Society for Information Display Symposium. This form of display (described in some detail hereinbelow) is known only in a reflective display form. Techniques for fabricating the micro-mechanical plates required by such a display in simple fashion and with high yield, are presently not available. It is not only highly desirable to provide transmissive electroscopic display devices, but to also provide a method for fabricating the micro-mechanical microscopic plates in simple and high-yield fashion.

BRIEF SUMMARY OF THE INVENTION

In accordance with one aspect of the invention, a member comprised of a moveable perforated metal plate, having spring members attached between the periphery thereof and a fixed mounting portion for mounting upon the surface of a substrate, is fabricated by sequentially depositing upon the substrate surface at least one layer of an etchable material, over-deposited with a layer of conductive material from which the member is to be formed. The outline of the member, and the placement of apertures therethrough, is defined by a previously deposited photo-resist layer. The photo-resist is then removed and portions of the at least one etchable layer are etched away to provide a thin apertured plate, suspended above the substrate surface by the remaining, unetched portions of the at least one layer. The plate/spring/support member-bearing substrate is utilizable in either reflective or transmissive displays.

In accordance with another aspect of the present invention, a transmissive electroscopic display device is provided by utilizing the above-described structure with a front substrate having at least one transparent electrode upon the interior surface thereof, and positioned spaced from, but facing, the electroscopic member-bearing rear substrate. The fixed portion of the plate member includes reflective elements positioned to align with the apertures in the moveable plate, when the plate is adjacent to the rear substrate surface.

Accordingly, it is one object of the present invention to provide a novel method for fabricating at least one micro-mechanical electroscopic plate member upon a substrate surface.

It is another object of the present invention to provide novel transmissive electroscopic displays.

These and other objects of the present invention will become apparent upon consideration of the following detailed description, when read in conjunction with the drawings.

DETAILED DESCRIPTION OF THE INVENTION

Figure 1:
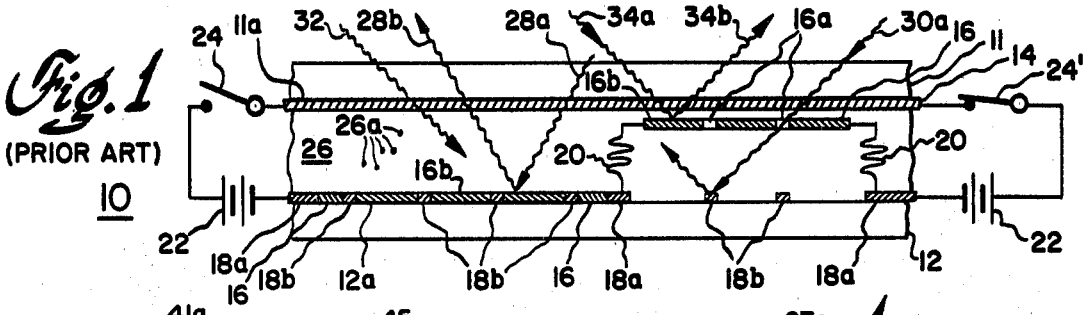
Fig. 1 (PRIOR ART)
FIG. 1 is a sectional side view of a portion of a prior art reflective electroscopic display device.

Referring initially to FIG. 1, the reflective electroscopic display 10, described by te Velde, utilizes an transparent front substrate 11, spaced from a rear substrate 12. Substantially all of the interior surface 11*a* of the front substrate supports a transparent electrode 14. The interior-facing surface 12*a* of the rear substrate supports a conductive electroscopic plate portion 16, having a plurality of apertures 16*a* therethrough, and a substantially complimentary fixed electrode portion 18, having support portions 18*a* fixed to substrate surface 12*a* and other portions 18*b* which are coincident with apertures 16*a* in the electroscopic plate when the plate is in the rest position, substantially coplanar with fixed portions 18. A portion of the conductive material layer is so formed as to provide spring arms 20 (shown relatively schematically in FIG. 1) between fixed support portions 18*a* and the periphery of the moveable plate 16. A potential source 22 is electrically connectable, via switch means 24, between the continuous front electrode 14 and the continuous, conductive rear electrode formed of at least moveable plate portion 16.

The "camera obscura" reflective mode of operation requires a highly transmissive medium 26 between the substrates, a highly absorbant plate surface 16*b* and highly-reflective fixed portions 18*b*. In the "off" condition (with switch 24 open, as at the left of FIG. 1) the entering light ray 28*a* passes through reflective front substrate 11 and front electrode 14, through the transmissive fluid 26 and is reflected only from the relatively large rear fixed member 18; light infringing upon moveable plate 16 portions is substantially absorbed. The light beam 28*b*, reflected only from portions 18*b*, passes back through transmission medium 26 and the transparent front electrode 14 and front substrate 11, and is visible to an observer stationed in front of substrate 11, albeit with relatively low intensity (due to the ratio of reflector area of portions 18*b* to absorber area of plate surfaces 16*b*). In the "on" condition, switch 24' is closed, and the electrostatic force between front electrode 14 and moveable plate portion 16 causes plate 16 to be attracted upwardly to the front electrode. Entering light ray 30*a* is either absorbed at the dark front surface 16*b* of the moveable plate portion, or passes through one of apertures 16*a*. The position of apertures 16*a* are so located that any light ray 30*a* passing through an aperture 16*a* and then reflected from a stationary portion 18*b* will impinge upon a solid portion of moveable plate 16, whereby light is not reflected from the "on" portion of the display (at the right-hand portion in the illustration thereof).

In the "electroscopic fluid display" mode, media 26 supports a multiplicity of light-absorbing pigment particles 26*a*. In the "off" condition (left portion of FIG. 1) the entering light ray 32 is substantially absorbed by the pigmentation particles and is not reflected. In the "on" (right-hand) portion of the display, entering light ray 34*a* travels a very small distance through the pigmented media 26, and is thus relatively unattenuated, upon arrival at the upper surface 16*b* of the moveable plate member portion 16. This surface 16*b* is highly reflective, in the electroscopic fluid display, and reflects the impingent light ray to be viewable as a light ray 34*b* by an observer situated in front of the display.

Figure 2:
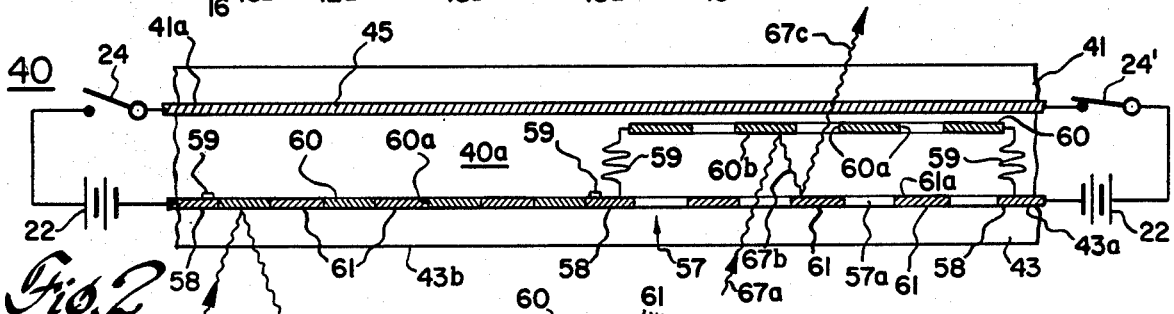
FIG. 2 is a section side view of a portion of a transmissive electroscopic display device in accordance with the present invention.
Figure 2A:
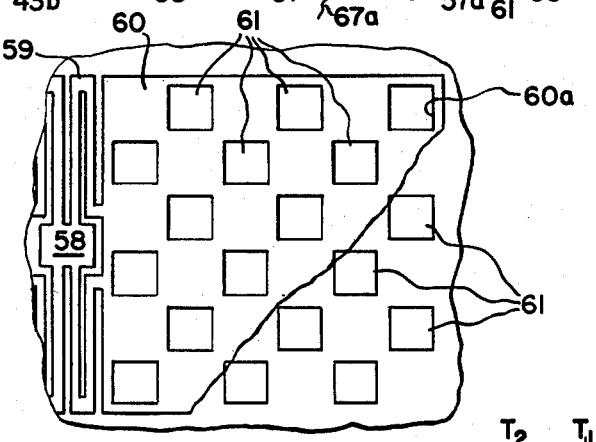
FIG. 2*a* is a partially sectionalized top view of a portion of the display of FIG. 2, illustrating the relationship between the moveable and nonmoveable rear electrode plate member portions, in accordance with the principles of the present invention.

Referring to FIGS. 2 and 2*a*, in accordance with one aspect of the present invention, a transmissive electroscopic display 40 includes a front transparent substrate 41, having an interior surface 41*a* spaced from and substantially parallel to the interior substrate 43*a* of a substantially transparent rear substrate 43. At least one substantially continuous conductive electrode 45 is fabricated upon front substrate interior surface 41*a*. A conductive electrode structure 57 is fabricated upon rear substrate interior surface 43*a*, and includes support portions 58 fixedly attached to substrate surface 43*a*, and joined via spring arm sections 59 to a micromechanical moveable plate portion 60. In the normal resting position, as shown at the left-hand portion of FIG. 2, moveable portion 60 is substantially coplanar with the fixed support portions 58 and spring arm portions 59. A large portion, e.g. approximately 50%, of the surface area of moveable plate 60 has a pattern of apertures 60*a* formed therethrough, with complimentary shaped electrode portions 61 protruding through the apertures 60*a*, in the rest position. Portions 61 are fixedly attached to rear substrate surface 43*a* and have dimensions slightly smaller than the corresponding dimensions of apertures 60*a*, whereby, when plate 60 is normally resting coplanar with stationary support portions 58 and electrode portions 61, substantially all of apertures 60*a* are filled by electrode portions 61. It should be understood that portions 61 may also lie under apertures 60*a*, or that portions 61 may be slightly larger than apertures 60*a* whereby, at rest, apertures 60*a* are totally blocked. Advantageously, at least the bottom plate surface 60*b* and the top electrode portion surfaces 61*a* are highly reflective.

In operation, a light source (not shown) is positioned behind the rear substrate exterior surface 43*b*, and provides light rays obliquely impingent thereon. When the display cell is in the "off" condition, with plate 60 resting adjacent to rear substrate surface 43*a* and substantially coplanar with support portions 58 and electrode portions 61 (as may occur when switch 24, in series with a potential source 22, is open-circuited), a light ray 65*a* will be transmitted through the substantially transparent rear substrate 43, but will be substantially blocked and reflected, as light ray 65*b*, at the electrode structure 57 surface closest to the rear substrate. The display portion defined by that cell is viewable as a dark area. In the "on" condition, as when closed switch 24' connects potential source 22 between front electrode 45 and the conductive rear electrode structure 57, the electrostatic force counteracts the pull of spring arms 59 and plate 60 moves to a position adjacent to the interior surface of electrode 45. An obliquely-entering light ray 67*a* passes through the substantially transparent rear substrate 43 and through one of the openings 57*a* formed between support portions 58 and electrode portions 61 (and occupied in the "off" condition by a solid portion of plate 60). Entering light ray 67*a* passes through the cell and is reflected at the plate rear surface 60*b*, as a reflected light ray 67*b*. The reflected light ray 67*b* travels back through the interior of the cell and either exits through another electrode aperture 57*a* and the rear substrate, or is reflected at the front surface 61*a* of one of electrode portions 61, as a double-reflected light ray 67*c*. The double-reflected light ray 67*c* traverses the interior of the cell and, due to the positioning of the electrode portions 61 and the solid portions of plate 60, passes through a plate aperture 60*a*, the substantially transparent front electrode 45 and the substantially transparent front substrate 41, emerging from the front of the cell as a transmitted light ray viewable by an observer stationed in front of cell 40. It should be understood that operation with a multiplicity of reflections, between plate rear surface 60*b* and portion 61*a* surfaces, is possible before the reflected ray is transmitted through the front substrate. It should also be understood that the display may be a matrix display, with a plurality of front electrode 41 stripes aligned in a first direction, and a plurality of lines of plates 60, with each plate line extending in a second direction substantially orthogonal to the first direction.

Figure 3A:
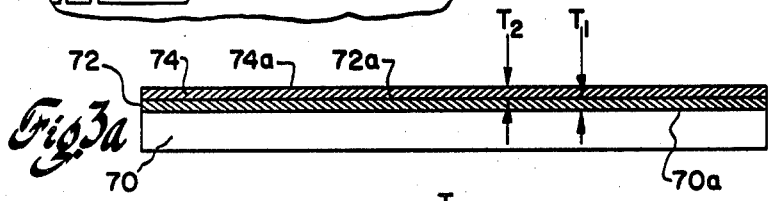
FIGS. 3*a*–3*d* are sequential side views illustrating the method for fabricating the micro-mechanical electroscopic display members upon a display substrate, in accordance with the principles of the present invention.

Referring now to FIGS. 3*a*–3*d*, in accordance with another aspect of the present invention, the support-spring arm-moveable plate electrode of an electroscopic display (of either the reflective or transmissive type), is fabricated upon a substantially transparent, e.g. glass and the like, substrate 70. A thin layer 72 of a first etchable conductive material, such as chrome and the like, is fabricated to a first thickness $T_1$, e.g. on the order of 40 nanometers, upon substrate surface 70*a*. A second layer 74 of an etchable conductive material, which is preferably of a material different from the material of first layer 72, and etched by a substance different than the substance utilized for etching the material of first layer 72, is fabricated upon that surface 72*a* of the first layer furthest from substrate 70. Illustratively, second layer 74 is fabricated of copper, to a thickness $T_2$ on the order of 200 nanometers. Layers 72 and/or 74 may be fabricated by sputtering, evaporation and the like processes. Preferably, the first layer 72 is formed of a material providing increased adhesion for the material of the second layer 74 to the material of the underlying substrate 70. A side view of the structure thus far formed is illustrated in FIG. 3*a*.

Figure 3B:
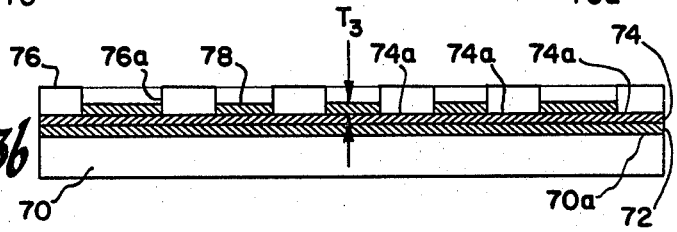
Figure 3C:
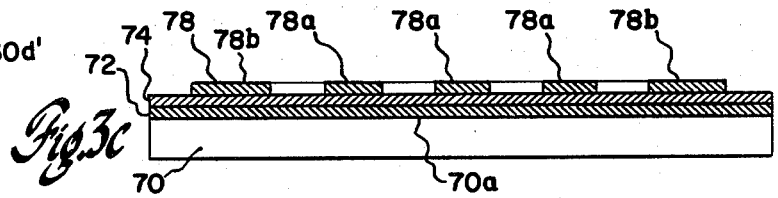

Thereafter, a patterned layer 76 of a photo-resistive material is fabricated upon second layer surface 74*a* (FIG. 3*b*). The photo-resistive material layer 76 is patterned with apertures 76*a* positioned to define the placement of the solid portions of the support-spring arm-plate electrode 57 (see FIGS. 2 and 2*a*). Thus, photo-resistive layer 76 is the negative of the desired spring plate pattern. Thereafter, a third layer 78 of a conductive material, such as nickel and the like, is fabricated upon the non-photo-resist-bearing portions of the second layer surface 74*a*. Illustratively, third layer 78 may be fabricated of nickel, to a thickness $T_3$ on the order of 100 nanometers, by electro-plating in a nickel sulfamate bath, to provide a low-stress nickel film layer 78.

Figure 3D:
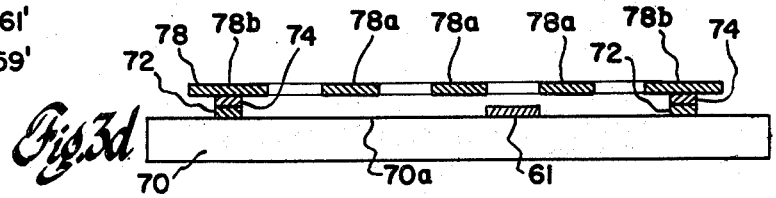

Thereafter, photo-resist layer 76 is removed (FIG. 3*c*) and the positive plate pattern of the conductive material of layer 78 exists atop the first and second layers 72 and 74. The rear substrate-electrode assembly is immersed in a bath of a material selected to (a) etch at least the material of second layer 74 and (b) have substantially no effect on layer 78. The etching time is controlled to be long enough so that there is sufficient etching and undercutting of second layer 74 to remove the portions of that layer underneath the plate portions 78*a*, but insufficient to remove portions of layer 74 underneath the larger layer portions 78*b* which will form support portions 58 (see FIG. 2*a*). Thereafter, a different etchant bath is used to remove the material of layer 72, in the same manner, whereby all of the first and second layer material underneath plate portions 78*a* are removed, and a "pillar" of first and second layer material remains beneath the electrode support portions 78*b*, attaching those portions to the substrate surface 70*a* (FIG. 3*d*). Electrode portions 61 may, for example, then be fabricated by masking the surface of electrode 78 and evaporating the portions 61 through the resulting apertures in plate 78. The resulting cantilevered spring arm-plate portion (supported by the remaining deposits of layers 72 and 74) and the associated rear substrate may then be assembled with a front glass substrate, having one or more transparent front electrodes, overcoated with an insulating layer, thereon. In addition, spacers and the like may be used in manner known to the display (and particularly the liquid crystal display cell) art, to complete the display. The cell interior volume 40*a* may be under vacuum, or filled with a gas, or a clear or colored liquid, all as desired for the end display.

Figure 4:
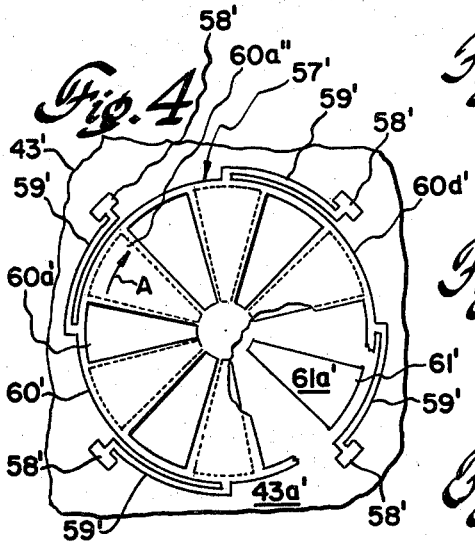
FIG. 4 is a partially-sectioned plan view of another preferred embodiment of a transmissive electroscopic display device in accordance with the principles of the present invention.

Referring now to FIG. 4, an alternative support-spring arm-plate member 57' utilizes plate 60' rotation, in the direction of arrow A, to provide rotational movement of sector-shaped apertures 60*a'*, when plate 60' is subjected to electrostatic attraction and movement towards the front electrode (not shown). In this embodiment, the plate has a substantially circular periphery 60*d'*, with a first end of each of a plurality of arcuate spring arms 59' being attached to an associated point equally spaced about the plate periphery. The remaining end of each spring arm is attached to an associated one of a like number of support portions 58', themselves attached to the surface 43*a'* of rear substrate 43'. Stationary portions 61' may also be sector-shaped and, if such portions have a highly-reflective surface 61*a'*, may be exposed only when the sector-shaped plate apertures 60*a'* are rotated, in the direction of arrow A, responsive to the electrostatic force, to adjacent positions, as e.g. the position of sector aperture 60*a''*. The sector-shaped reflective portions 61' will be covered by the solid portions of circular plate 60'', in the "off," or rest, position of the transmissive display thus formed.

While several embodiments of my novel transmissive electroscopic display device, and a presently preferred method for fabricating the support-spring arm-plate member for an electroscopic display of either the reflective or transmissive type, have been described in detail herein, many modifications and variations will now become apparent to those skilled in the art. It is my intent, therefore, to be limited only by the scope of the appending claims, and not by the details disclosed herein.

What is claimed is:

1. An information display device, comprising:

first and second substantially transparent substrates, each having an interior surface spaced from and facing the interior surface of the other substrate;

at least one conductive electrode fabricated upon the interior surface of a first one of said substrates;

a conductive electrode fabricated directly upon the interior surface of the second one of said substrates and comprising at least one support portion directly attached to the second substrate interior surface, at least one plate portion having a substantially circular periphery and at least one sector-shaped aperture formed therethrough within said periphery, and a plurality of arcuate spring arms each having a first end attached to a point on the periphery of an associated plate portion substantially equally spaced from adjacent spring arm attachment points and having a second end connected to an associated fixed support portion for mechanically biasing said plate portion toward said second substrate interior surface;

said plate portion being adapted for movement, against the force of said arcuate spring arms, toward said electrode fabricated upon said first substrate interior surface, responsive to the coupling of a potential between the electrodes on the interior surface of said first and second substrates, and with the position of each of said at least one sector-shaped apertures rotating about a plate portion center as said plurality of arcuate spring arms are flexed by movement of said plate portion toward and away from said second substrate interior surface; and a multiplicity of reflective members each fixed to said second substrate interior surface and positioned such that light entering said display through said second substrate and reflected from that surface of said plate portion closest to said second substrate, when said plate portion is electrostatically moved closest to said first substrate electrode, is reflected from said fixed reflective members through said plate portion apertures and said first substrate and the electrode thereon.

2. The display of claim 1, wherein each of said fixed reflective members is sector shaped.

3. The display of claim 2, wherein each of said fixed members is sized and positioned to fit within an associated aperture in said plate portion, when said plate portion is at rest substantially adjacent to said second substrate interior surface.

4. The display of claim 1, wherein said plate portion apertures and said fixed reflective members are so proportioned and positioned to cause light entering through said second substrate to be substantially totally reflected when said plate portion is in a rest position substantially adjacent to said second substrate interior surface.

5. The display of claim 1, wherein said plate portion apertures occupy approximately 50% of the plate area.

6. A method for fabricating a perforated conductive plate moveably positionable with respect to a surface of a substrate, and having spring members attached between the periphery of the plate and at least one fixed mounting portion mounted upon the substrate surface, comprising the steps of:

providing the substrate of a preselected material;

fabricating at least one layer of an etchable material directly upon the substrate surface, said at least one layer having a surface furthest from the substrate surface;

fabricating upon the at least one layer furthest surface a layer of a masking material having apertures therethrough positioned at locations at which the plate, spring members and mounting portions are to be located;

fabricating, within the apertures of the masking layer, a topmost layer of a relatively etch-resistant conductive material;

removing the masking material;

etching the at least one etchable material layer away at least between the plate and spring member portions of the topmost layer and said substrate surface; and preventing etching of at least a support pillar of said at least one etchable material layer, between the substrate surface and each of the fixed mounting portions.

7. The method of claim 6, wherein the at least one layer fabricating step includes the steps of:

fabricating directly upon said substrate surface a first layer of a first selectively-etchable material; and fabricating at least a second layer of a different conductive, selectively-etchable material upon the surface of the first layer furthest from the substrate.

8. The method of claim 7, wherein each of said first and second layers is fabricated of a conductive material selectively etched by an etchant which does not appreciably etch the remaining layer materials.

9. The method of claim 3, wherein said first layer is fabricated of chrome.

10. The method of claim 3, wherein said first layer has a thickness on the order of 40 nanometers.

11. The method of claim 8, wherein said second layer is fabricated of copper.

12. The method of claim 8, wherein the second layer has a thickness on the order of 200 nanometers.

13. The method of claim 6, wherein said etch-resistant material is fabricated to a thickness on the order of 1,000 nanometers.

14. The method of claim 13, wherein said etch-resistant material is nickel.

15. The method of claim 14, wherein said nickel layer is fabricated by electroplating.

16. The method of claim 15, wherein said electroplated nickel is fabricated in a nickel sulfamate bath.

17. The method of claim 6, wherein said substrate is fabricated of a substantially transparent material.

18. The method of claim 6, wherein at least the surface of said plate closest to said substrate surface is fabricated with a highly reflective finish.

19. The method of claim 6, wherein said masking material is patterned to provide a multiplicity of apertures in said plate.

20. The method of claim 19, wherein said apertures occupy approximately 50% of the plate portion area.

* * * * *